United States Patent [19]

Butch

[11] Patent Number: 4,986,196

[45] Date of Patent: Jan. 22, 1991

[54] SOLID WASTE INCINERATOR SYSTEM

[76] Inventor: Adam F. Butch, P.O. Box 916, Casselberry, Fla. 32707

[21] Appl. No.: 565,728

[22] Filed: Aug. 13, 1990

[51] Int. Cl.[5] ..... F23G 5/00; F23G 5/12

[52] U.S. Cl. ..... 110/235; 110/210; 110/211; 110/248; 110/258

[58] Field of Search ..... 110/235, 240, 248, 253, 110/258, 259, 210, 211

[56] References Cited

U.S. PATENT DOCUMENTS 4,944,236 7/1990 Sheen ..... 110/235 X 4,949,653 8/1990 Rast ..... 110/235

*Primary Examiner*—Edward G. Favors

*Attorney, Agent, or Firm*—William M. Hobby, III

[57] ABSTRACT

A solid waste incinerator apparatus has an elongated hearth having a plurality of walls and a floor and an elongated open side having a track mounted to each side of the open hearth. The hearth has a grate mounted above the floor thereof. A burner car has a plurality of motorized wheels riding in the elongated track for moving the burner car over the open side of the hearth. The burner car has a plurality of burners mounted thereon having a flame directed into the hearth to incinerate solid refuse in the hearth. The burner car also has a solid refuse agitation system thereon having at least one drum with cutting discs mounted therein to agitate the trash prior to incineration with the burners. A plurality of plenums are connected to one side of the hearth beneath the grate for drawing heated gases and burned ash therethrough. Each plenum forms a zone in the hearth for the removal of heated gases and ash from the zone within the elongated hearth as the burner car incinerates the refuse in that zone. Each plenum has a suction fan to draw the heated gas and burned ash through the plenum and into an ash moving cyclone and an afterburner.

10 Claims, 4 Drawing Sheets

SOLID WASTE INCINERATOR SYSTEM

BACKGROUND OF THE INVENTION

The present invention relates to an incineration system and especially to an incinerator for solid refuse.

As municipal land waste areas continue to become completely filled, alternate methods of refuse disposal assume an increasingly large importance. This problem results in efforts to totally destroy the refuse, especially through burning. This undertaking must comply with current environmental restrictions but burning the material and recovering the heat energy produced is an especially tantalizing goal in an age of high energy cost.

The main combustion chambers that the entering refuse initially encounter have also witnessed a wise degree in variation of designs. Some incinerators place the refuse upon a grate bed. This allows the air or other oxygen-containing gas to readily and uniformly intermingle with the refuse to assure complete combustion. However, unburned ash, plastics, wet refuse, and liquids may simply drop down through the grates to the bottom of the incinerator. There they undergo combustion and can provide excessive heat to the incinerator's lower surface and grating structure, possibly damaging them. A hearth, or refractory, floor represents an alternative to the grate support for refuse.

Initially, the refuse upon the floor must receive an even distribution of oxygen in order for the bulk of the material to burn. This throughput of oxygen does not occur if the air simply passes into the combustion chamber over the burning refuse; it must enter underneath the waste material and disperse throughout. The uniform dispersion of the air into the waste requires the placement of air nozzles within the hearth floor itself. However, the heavy refuse sitting upon the floor has shown an unmistakable propensity to clog and destroy the effectiveness of the air-introducing nozzles. As a result, the refuse does not undergo efficient and thorough combustion.

To prevent the clogging of nozzles in a hearth floor, some incinerators force the air through at a high velocity. However, the fast-moving gases display a tendancy to entrain particles and produce smoke. Furthermore, the high velocities have a tendency to create a "blow torch" effect and produce slag. The slag may then stick to the hearth floor and interfere with the chamber's subsequent operation.

Incinerators currently in use employ drastically different geometric designs for the initial combustion chamber. For example, some use a tall compartment occupying a relatively small horizontal area. Others utilize cylindrical chambers with the main axis of cylindrical symmetry lying horizontally. Most also use chambers with a minimal volume to permit the burning of the intended refuse. All of these factors increase the velocity of gases passing through and thus the entrainment of particulate, smoke-producing material.

The incinerators of the days before environmental concern simply released their exhaust gases from the combustion chamber into the atmosphere. The detrimental effect of these gases upon the environment has resulted in prohibitions of their continued use. Moreover, it has led to the development of additional techniques for controlling the pollutants produced in the combustion chamber.

Efforts to control pollution have often centered upon the use of a reburn tunnel to effectuate further combustion of the main combustion chamber's exhaust. The gases, upon departing the main combustion chamber, immediately enter the reburn unit. The tunnel may include a burner to produce heat and a source of oxygen, usually air, to complete the combustion process. The additional oxygen, of course, represents an essential ingredient for the starved-air incinerators. Depending upon the material introduced in the main chamber, the reburn unit provides a set amount of fuel to the burner and a specified amount of oxygen.

Furthermore, many incinerators, while attempting to avoid degrading the environment, have also sought to recover the heat produced by the combustion. Some try to capture heat directly within the main combustion chamber. Others choose to locate a boiler adjacent the reburn unit, maximizing the recovery of the produced energy while avoiding substantial pollution.

Prior U.S. patents having incinerator systems can be seen in the Spitz et al. U.S. Pat. No. 4,183,307 for a pollution control incinerator system having a series of connected combustion stations each one connected in series to the other with a branch duct. The Schregg U.S. Pat. No. 3,785,305 teaches an incinerator where the refuse is fed into a main combustion chamber by a compactor through a chute and the gases are fed to an afterburner air feed system. The Beausoleil et al. U.S. Pat. No. 4,850,289 teaches an incinerator having a loading member with a burning chamber and a combustion chamber along with a duct member connecting the burning and the combustion chambers. The Basic Sr. U.S. Pat. No. 4,438,705 teaches an incinerator with two reburn stages and optional heat recovery. The Normantas U.S. Pat. No. 4,029,026 teaches an incinerator which eliminates the independently fired afterburner. The LePori et al. U.S. Pat. No. 4,848,249 teaches a system for conversion of trash to usable energy in which the trash is fed into a primary burner while the exhaust is fed through a series of vortexes to remove ash and the like and the exhaust is then fed to an afterburner. The burning is from the bottom of the principal combustion chamber.

The present invention relates to a multistage incinerator having an elongated hearth having a plurality of plenum ducts feeding from different portions thereof and having a burner car mounted on a track on an open side of the hearth for passing the burner and a refuse agitating system from one zone to another zone along the hearth. The hearth can be continuously refilled as the burner car moves from one zone to the other across the length of the hearth. Each of the plenums is powered by an independent fan feeding a cyclone ash remover and an afterburner.

SUMMARY OF THE INVENTION

A solid waste incinerator apparatus has an elongated hearth having a plurality of walls and a floor and an elongated open side having a track mounted to each side of the open hearth. The hearth has a grate mounted above the floor thereof. A burner car has a plurality of motorized wheels riding in the elongated track for moving the burner car over the open side of the hearth. The burner car has a plurality of burners mounted thereon having a flame directed into the hearth to incinerate solid refuse in the hearth. The burner car also has a solid refuse agitation system thereon having at least one drum with disc cutters mounted thereon to cut up the trash prior to incineration with the burners. A plurality of plenums are connected to one side of the hearth beneath the grate for drawing heated gases and burned ash therethrough. Each plenum forms a zone in the hearth for the removal of heated gases and ash from the zone within the elongated hearth as the burner car incinerates the refuse in that zone. Each plenum has a suction fan to draw heated gas and burned ash through the plenum and into an ash moving cyclone and an afterburner.

BRIEF DESCRIPTION OF THE DRAWINGS:

Other objects, features, and advantages of the present invention will be apparent from the written description and the drawings in which.

DESCRIPTION OF THE PREFERRED EMBODIMENT

Figure 1:
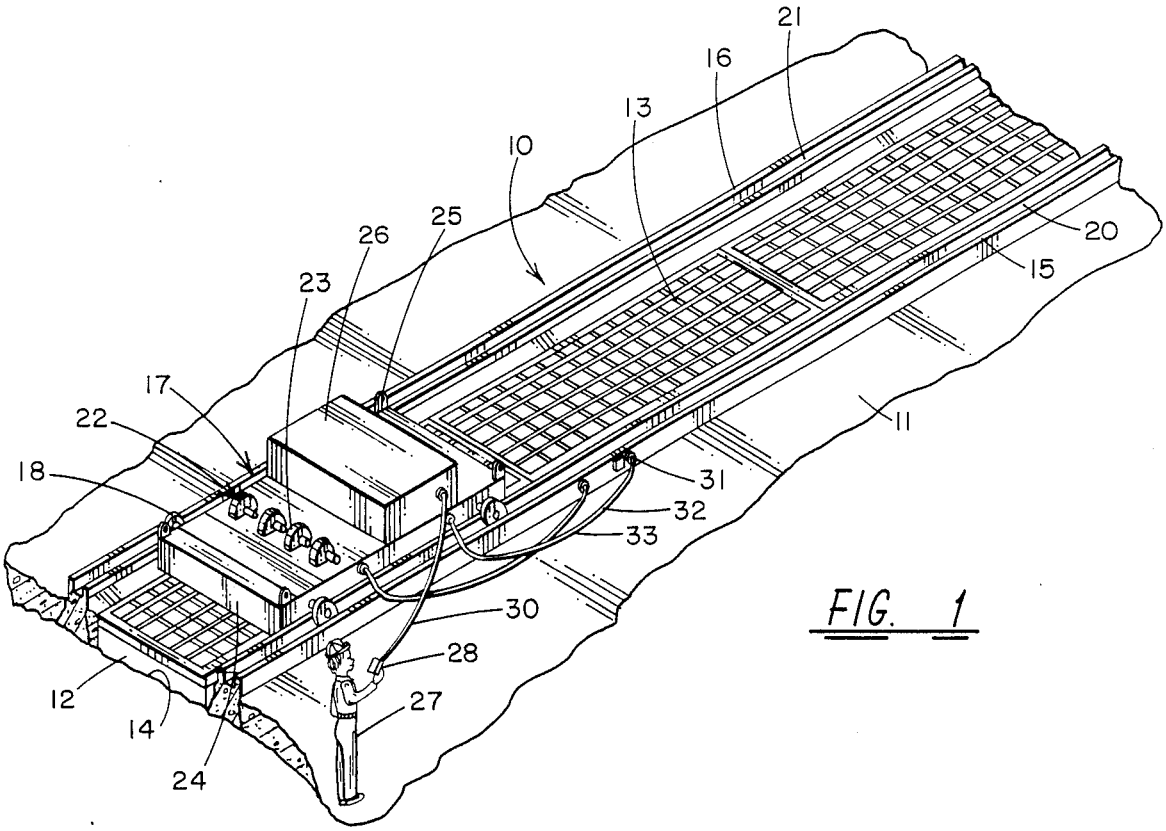
FIG. 1 is a partial perspective of an incinerator in accordance with the present invention.

Referring to the drawings and especially to FIGS. 1–4, a solid refuse incinerator 10 is mounted in a floor 11 having a sunken elongated hearth 12 and having a grate 13 positioned above the floor 14 of the elongated hearth 12. A pair of elongated wheeled tracks 15 and 16 are mounted on either side of the elongated hearth 12 and a hearth burner car 17 has a plurality of wheels 18 riding in the tracks 15 and 16. The track 15 has an elongated groove 20 for the wheels 18 to ride in while the track 16 has an elongated groove 21 for the wheels. The burner car 17 has a plurality of burners 22, each having a burner fan 23 positioned on top of the burner car frame 24. The burner car also has four hook brackets 25 so that the burner car can be hooked from an overhead winch or crane and lifted for replacement and repair. The burner car 17 has a housing cover 26 which encloses the controls for driving the burner car as well as the trash agitating system. An operator 27 is shown with a control box 28 connected through a control cable 30 through the housing 26 while an electrical cable 30 is connected from an electrical receptacle 31 mounted on the side of the track 15 to a connector 32 on the burner car 17. A burner fuel line 33 connects from a fuel connection into the burner car 17 to supply the plurality of burners 20 for incinerating solid refuse placed on the grates 13 in the elongated hearth 12.

Figure 2:
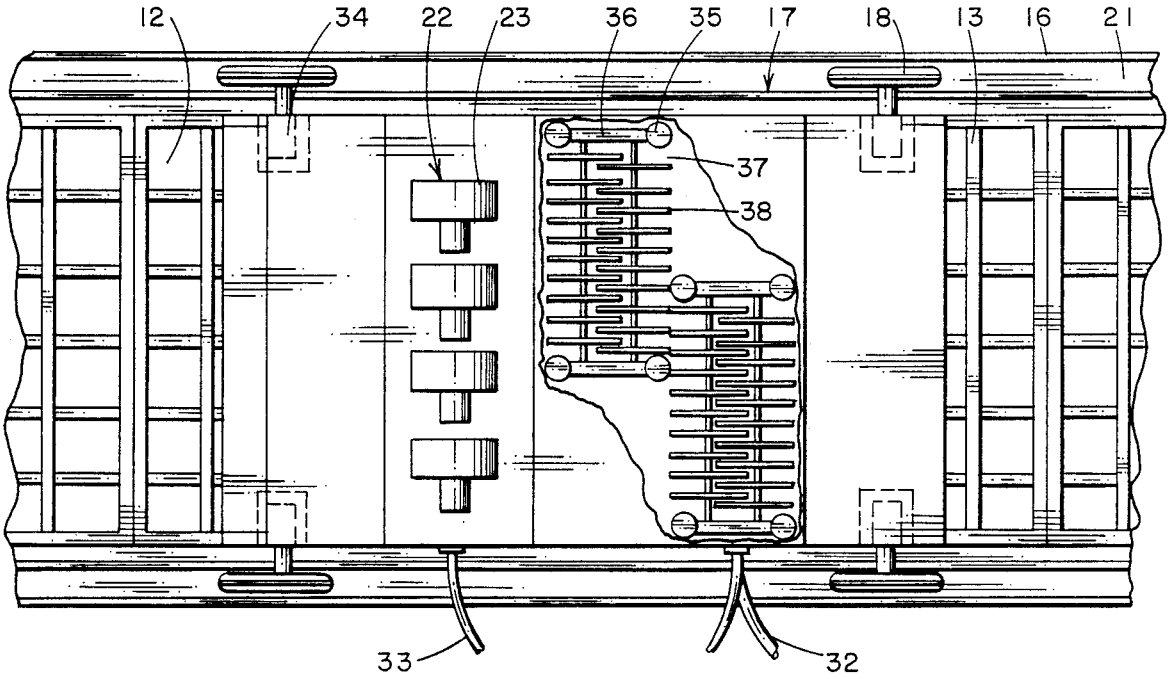
FIG. 2 is a top elevation with portions removed of the burner car riding over the hearth.

The burner car as seen in FIG. 2 has wheels 18 driven by a separate electric motor 34 which is driven in a forward or reverse direction by the operator 27 actuating the electric power to the wheels in a forward or reverse direction. The burner car 17, as shown in the cutout in FIG. 2, has a plurality of hydraulic cylinders 35 extending out the bottom thereof and supporting a disc supporting leaf spring 36 between each two hydraulic cylinders 35 for supporting cutting discs 37, each section having a plurality of toothed cutting discs 38 attached thereto for cutting and agitating and stirring up refuse beneath the burner car 17 just ahead of the flames of the plurality of burners 22. The discs are raised and lowered by cylinders but could of course be operated by electric actuators.

Figure 4:
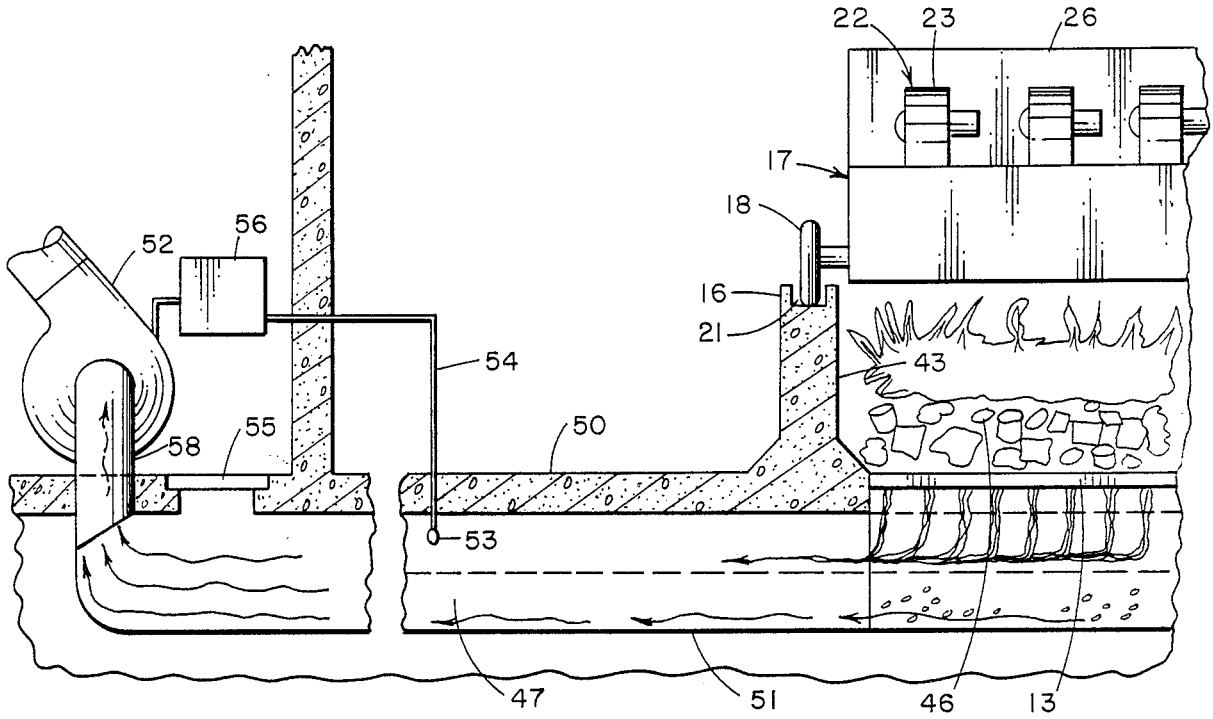
FIG. 4 is a sectional view taken through the incinerator of FIGS. 1–3.
Figure 3:
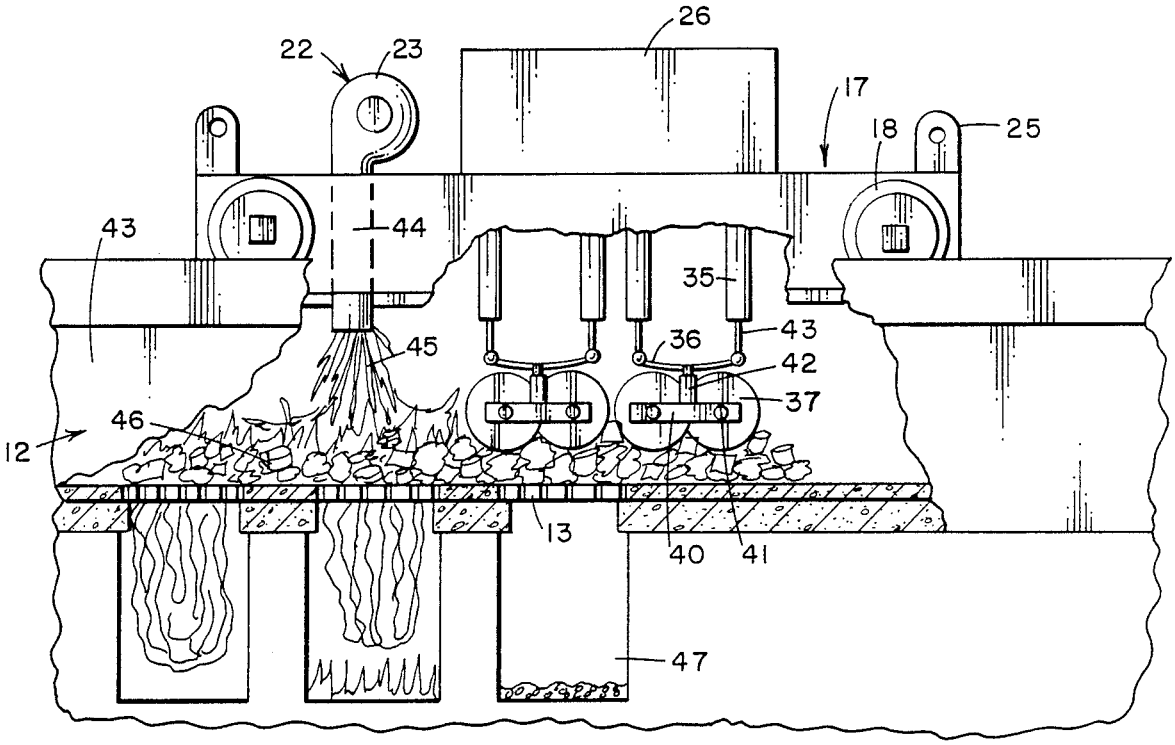
FIG. 3 is a cut-away side elevation of the incinerator of FIGS. 1 and 2.

As more clearly seen in FIG. 3, the hydraulic cylinders 35 are connected by the disc supporting leaf spring brackets 36 connecting the disc support members 42 each holding a pair of disc assemblies 37 riding on their axial pins 41 and each pair is supported by a cross bar 40 connected to the leaf spring bracket 36 connected between the pair of hydraulic rams 43. The hearth 12 has side walls 43 in this view and has the iron grates 13 mounted over the floor 14 and, as seen in this view, the burners 22 have a fan 23 and a downwardly extending burner housing 44 delivering a flame 45 out the end beneath the burner car 17 into a pile of solid refuse or trash 46 beneath the elongated hearth 12. A plurality of elongated plenum ducts 47 each extend from an opening 48 from the bottom of the hearth 12 below the grate 13. As shown in FIG. 4, the plenums 47 are below a concrete floor 50 and may be lined around the bottom and sides with a refractory lining 51 and pass under a concrete wall. Hot gases from the combustion in the hearth along with burned ash are pulled through the solid refuse 46 to pull the heat through the grate 13 through the plenums 47 and are drawn by a large blower fan 52. Because of the high temperature passing through the plenum 47, a temperature sensor 53 is placed therein at a position intermediate the hearth and the blower 50 and is connected by conductors 54 to a fan control 56 which can control the speed of the fan responsive to the amount of heat sensed by the sensor. 53. Fan 52 is also placed sufficiently remote from the burners and hearth to assist in maintaining the temperature control so as not to overheat the fan 52. A cleanout entrance 55 allows the plenum to be cleaned out.

Figure 5:
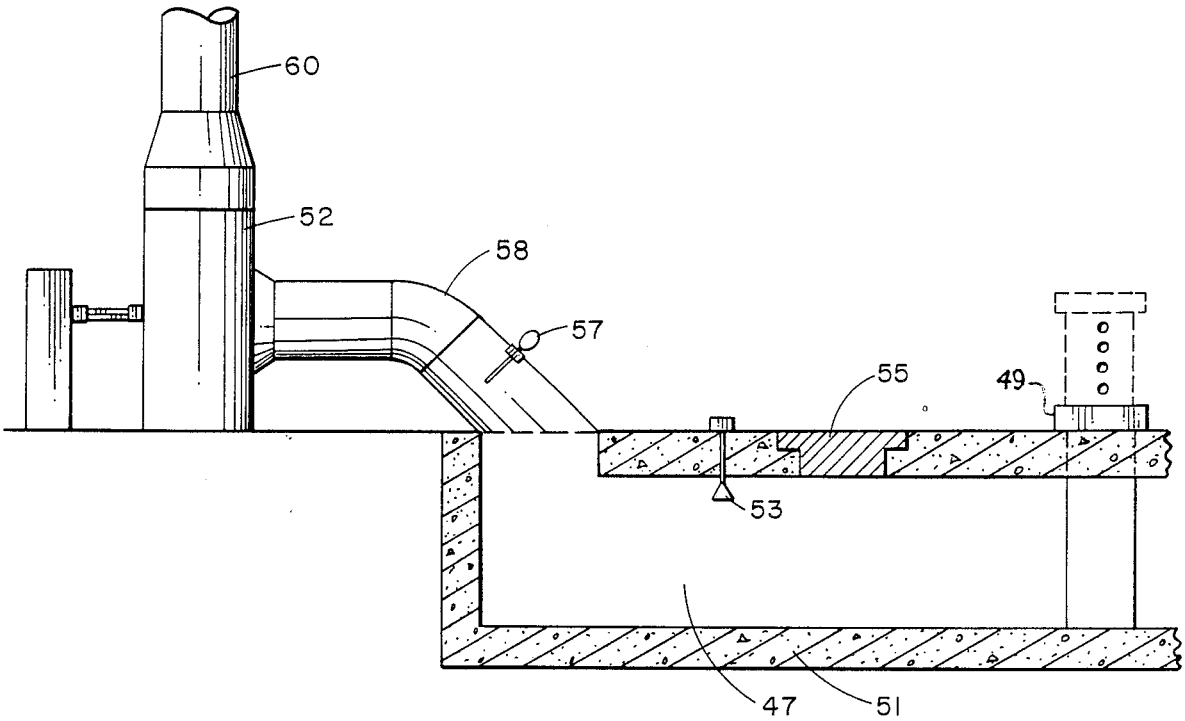
FIG. 5 is a partial sectional view of a portion of the incinerator of FIGS. 1–4.

In FIG. 5, a portion of one of the plenums 47 is illustrated having a temperature sensor 53 protruding therein and a cleanout 55. A damper 57 is placed in the fan pipe 58 leading to the blower 52 which blows air into an exhaust pipe 60.

Figure 6:
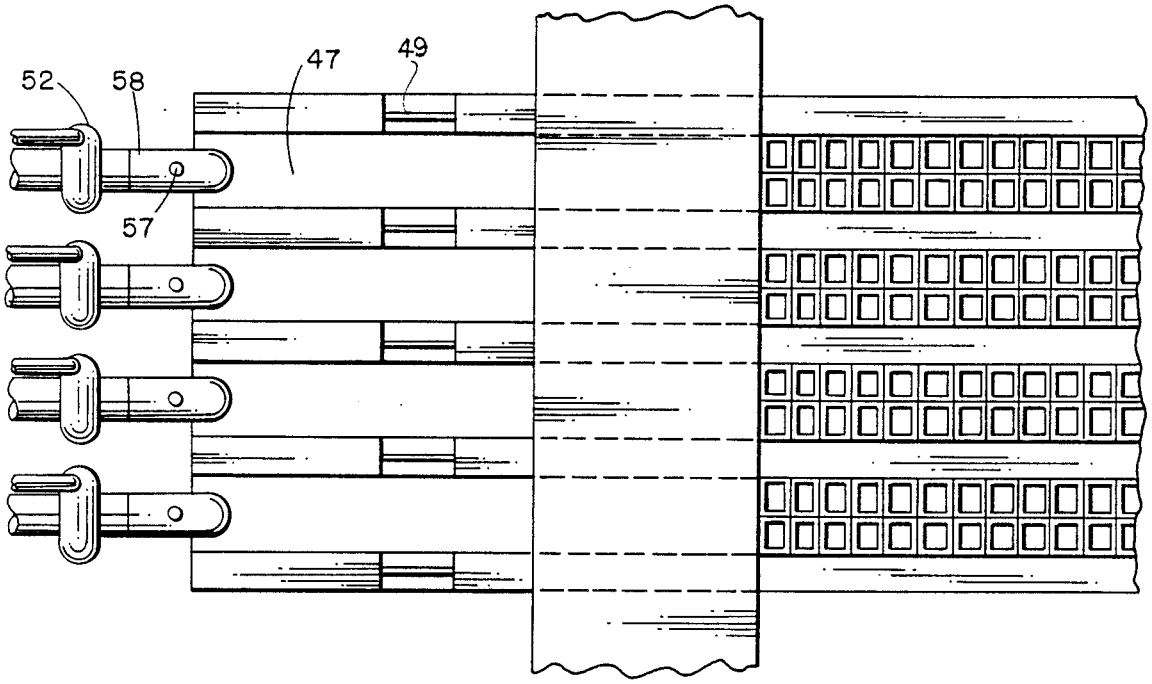
FIG. 6 is a top plan view of the exhaust plenum system of the incinerator of FIGS. 1–5.

In FIG. 6 there are four separate plenums in the embodiment shown with four separate fans 52, four separate fan pipes 58, and dampers 57 connected to the single elongated hearth. Each plenum forms one zone in the hearth. An interconnecting passageway and guillotine damper 49 is located between adjacent plenums 47 to control the flow of gases between plenums.

Thus, as the burner car 17 is moved over the loaded hearth filled with trash, as seen in FIG. 3, the rotating discs 37 cut into and stir up the trash, loosening it allows sufficient oxygen therebetween prior to the burners 22 directing a flame to burn the trash from the top down while the heated gas and ashes are drawn through the plenum 47 through the grate 13 only for that particular plenum adjacent a portion of the hearth in which the burner car 17 is passing over and burning the solid refuse. The elongated hearth 12 can have portions filled at all times while the incineration is taking place in another zone of the hearth to provide a continuous operation from one zone to the next using one set of burners and using a down draft to feed one blower at a time.

Figure 7:
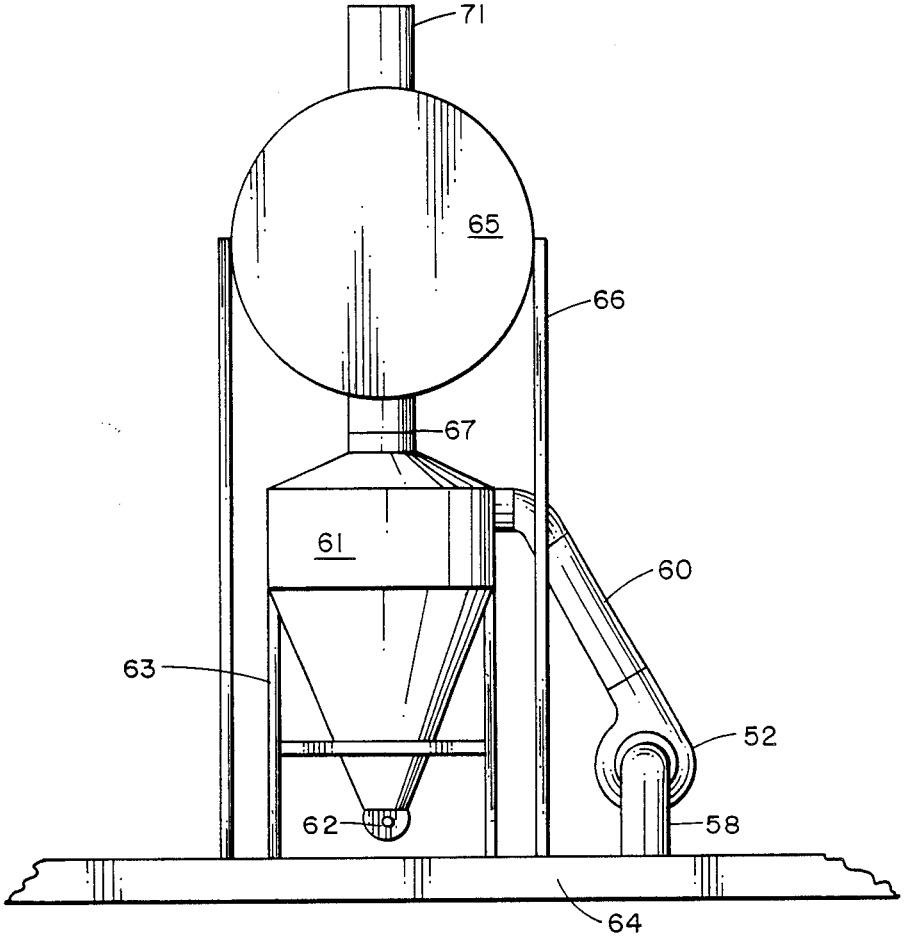
FIG. 7 is an end elevation of the cyclone and afterburner.
Figure 8:
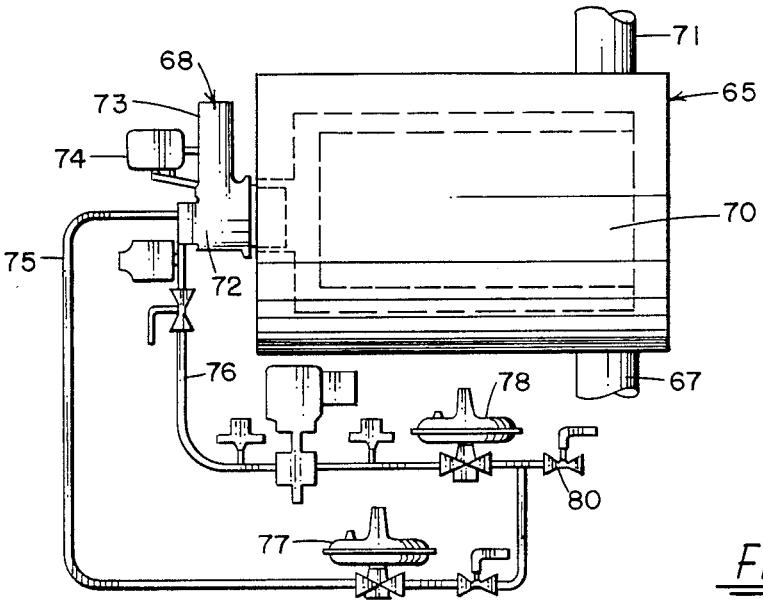
FIG. 8 is a top view of the afterburner.

As seen in FIGS. 7 and 8, the blower fan 52 is connected through the pipes 58 to the plenum and feed an exhaust or positive pressure gases and ash through a pipe 60 into a cyclone 61 which collects the ash in the bottom of the cyclone into an ash removal screw conveyor 62. The cyclone 61 is held with a metal framework 63 supported on a floor 64 and has an afterburner 65 mounted there on top with metal frame members 66. The afterburner 65 is of a conventional design and is connected from the cyclone 61 through a pipe 67 thereinto where the afterburning takes place following the removal of ash by the cyclone 61. The heated gases from the afterburner 65 which completes the combustion process and cleans the gases along with the cyclone cleaning the ashes from the gas, then emits the clean gas through an exhaust pipe 71 which is connected to a heat exchanger to remove the heat from the gases for utilization in the production of electricity, hot water, or the like. The afterburner 65 has a conventional burner 68 mounted to one end thereof feeding into a burner chamber 70 having the pipes 67 feeding thereinto and the exhaust pipe 71 feeding therefrom. The burner 68 is connected through a series of pressure regulators and fuel controls to feed the fuel to the burner portion 72 driven by a burner fan 73 operated by an electric motor 74 having the fuel line 75 and 76 connected thereto. Fuel line 75 has a pressure regulator and valve 77 connected therein while line 76 has a pressure regulator and valve 78 connected therein. The master shutoff valve 80 connects both lines and both feeds to the burner.

It should be clear at this point that a solid refuse incinerator has been provided which has one elongated hearth 12 having a plurality of zones therein so that trash can be loaded throughout the entire elongated hearth 12 having one burner car 17 with a plurality of burners 22 passing thereover for agitating the trash from the top into the burner flames being aimed downward into the refuse and that one or two of a plurality of bottom plenums 47 can be exhausting the heated gas and ash through the bottom grate 13 by separate large fans 52 connected to each plenum and each plenum 47 activates one zone of the hearth 12 and is connected to a separate cyclone and afterburner system. Thus, the intermittent operation of each exhaust fan 52, the cyclone, afterburner, and plenum helps maintain the temperature from reaching excessive degrees and allows the one burner car to operate continuously incinerating the solid refuse which has been dumped into the elongated hearth which is open along the top side.

The drawing of the air and gases through the solid refuse into the bottom plenum enhances the combustion of the refuse by the flames 45 from the burners 22, as does the loosening and spreading of the solid refuse with the cutting discs 37 which can be raised and lowered as desired for best operation through the actuation of the hydraulic cylinders 35. It should be clear at this time that a solid waste incinerator system has been provided using a common hearth and a common set of burners and agitators for the solid refuse but which is divided into zones having separate plenum ducts, blowers, ash moving cyclones and afterburners for each zone of the hearth. However, the present invention is not to be construed as limited to the forms shown which are to be considered illustrative rather than restrictive.

I claim:

1. A solid waste incinerator system comprising:

an elongated hearth having a plurality of walls and a floor and one elongated open side, said hearth having a grate mounted over the floor thereof whereby solid refuse can be dumped into said hearth from the open side for incineration thereof;

an elongated track positioned along said hearth opening side;

a burner car having a plurality of wheels riding in said elongated track for moving said burner car over said hearth, said burner car having a plurality of burners mounted thereon and having their flame directed into said hearth whereby said burners can incinerate said refuse in different positions along said elongated hearth;

a plurality of plenums connected through one side of said hearth beneath said grate for drawing heated gasses and burned ash therethrough, each said plenum forming a zone in said hearth for the removal of heated gasses and ash from said zone within said elongated hearth whereby said hearth forms a plurality of zones each fired by a single moving burner car;

a plurality of suction fans, one said fan located at end of each plenum for drawing said gasses and burned ash therethrough;

a plurality of cyclones, one said cyclone being mounted adjacent each said suction fan for removing ash from said gasses received from one said plenum; and a plurality of afterburners, each afterburner being coupled to one said plenum for further burning of said gasses and ash.

2. A solid waste incinerator system in accordance with claim 1 in which said burner car has solid waste agitation means thereon for agitating said solid waste in said hearth prior to said plurality of burners incinerating said solid refuse.

3. A solid waste incinerator system in accordance with claim 2 in which said burner car solid waste agitation means includes at least one rotating cutting disc for cutting up said solid waste in said hearth prior to said plurality of burners incinerating said solid refuse.

4. A solid waste incinerator system in accordance with claim 3 in which said burner car solid waste agitation means rotating cutting discs has a plurality of toothed cutting discs attached thereto for agitating said solid waste in said hearth prior to said plurality of burners incinerating said solid refuse.

5. A solid waste incinerator system in accordance with claim 4 in which said burner car solid waste agitation means has a plurality of rotating cutting discs, each disc having a plurality of toothed cutting discs attached thereto for agitating said solid waste in said hearth prior to said plurality of burners incinerating said solid refuse.

6. A solid waste incinerator system in accordance with claim 5 in which said burner car solid waste agitation means has two rotating agitating cutting discs, each disc having a plurality of toothed cutting discs attached thereto.

7. A solid waste incinerator system in accordance with claim 6 in which said burner car has a plurality of electric motor driven wheels riding in said elongated track for moving said burner car along said track.

8. A solid waste incinerator system in accordance with claim 7 having a plurality of temperature sensors, one sensor mounted in each said plenum for sensing the temperature of the hot gasses therein, each said sensor being mounted to control one said suction fan responsive to the temperature in said plenum.

9. A solid waste incinerator system in accordance with claim 8 in which said burner car solid waste agitation means plurality of rotating cutting discs are supported from said burner car by at least one hydraulic cylinder whereby the height of said each rotating cutting disc can be remotely controlled.

10. A solid waste incinerator system in accordance with claim 9 in which said burner car solid waste agitation means plurality of rotating cutting discs are supported from said burner car by a plurality of hydraulic cylinders whereby the height of said each rotating cutting disc can be remotely controlled.

* * * * *